US005979085A

United States Patent [19]

Ross et al.

[11] Patent Number: 5,979,085

[45] Date of Patent: Nov. 9, 1999

[54] DECORATIVE SHOE ACCESSORY

[76] Inventors: Michael E. Ross, 2170 Century Park East, Apt 1010, Los Angeles, Calif. 90067; Kenneth R. Costello, 3747 Regal Vista Dr., Sherman Oaks, Calif. 91403

[21] Appl. No.: 09/070,554

[22] Filed: Apr. 30, 1998

[51] Int. Cl.[6] ..... A43B 5/00; A43B 19/00; A43B 23/00

[52] U.S. Cl. ..... 36/136; 36/1; 36/132

[58] Field of Search ..... 36/1, 132, 136

[56] References Cited

U.S. PATENT DOCUMENTS

| | | | |
|---|---|---|---|
| D. 308,283 | 6/1990 | Bergman et al. . | |
| 1,229,940 | 6/1917 | Gomes . | |
| 1,542,189 | 6/1925 | Thompson | 36/132 |
| 1,640,665 | 8/1927 | Muscente | 36/136 |
| 2,022,554 | 11/1935 | Williams . | |
| 2,233,544 | 3/1941 | McKinley | 36/136 |
| 2,266,083 | 12/1941 | Rzepa . | |
| 2,464,859 | 3/1949 | Gilowitz | 36/136 |
| 2,650,399 | 9/1953 | Torelli . | |
| 2,871,537 | 2/1959 | Hickerson . | |
| 3,473,198 | 10/1969 | Meier . | |
| 4,536,975 | 8/1985 | Harrell . | |
| 4,597,198 | 7/1986 | Schweitzer . | |
| 4,712,319 | 12/1987 | Goria | 36/136 |
| 4,823,426 | 4/1989 | Bragga . | |
| 4,845,865 | 7/1989 | Chang et al. | 36/136 |
| 4,967,454 | 11/1990 | Elieff . | |
| 4,999,888 | 3/1991 | Miller . | |
| 5,042,119 | 8/1991 | Williams . | |
| 5,058,293 | 10/1991 | Villar . | |
| 5,063,690 | 11/1991 | Slenker | 36/136 |
| 5,136,726 | 8/1992 | Kellin et al. | 36/136 |
| 5,165,190 | 11/1992 | Smyth . | |
| 5,209,000 | 5/1993 | Rowland et al. | 36/136 |
| 5,259,094 | 11/1993 | Zepeda . | |
| 5,311,679 | 5/1994 | Birch, Sr. | 36/136 |
| 5,333,398 | 8/1994 | Seo . | |
| 5,402,589 | 4/1995 | Lubrani et al. . | |
| 5,459,947 | 10/1995 | Lasher . | |
| 5,496,612 | 3/1996 | Ransbottom | 36/136 |
| 5,526,551 | 6/1996 | Herman . | |
| 5,566,477 | 10/1996 | Mathis et al. . | |
| 5,596,821 | 1/1997 | Solo . | |
| 5,671,517 | 9/1997 | Gourley . | |
| 5,775,011 | 7/1998 | Reitano, Jr. | 36/136 |

*Primary Examiner*—Paul T. Sewell
*Assistant Examiner*—Anthony Stashick
*Attorney, Agent, or Firm*—Oppenheimer Wolff & Donnelly LLP

[57] ABSTRACT

A body portion of a decorative shoe accessory is located beneath the flaps of the shoe and is releasably attached to the shoe by frictional engagement associated with the overlying configuration of the flaps relative to the body of the accessory. The accessory includes a three-dimensional object releasably attached thereto.

6 Claims, 4 Drawing Sheets

FIG. 1
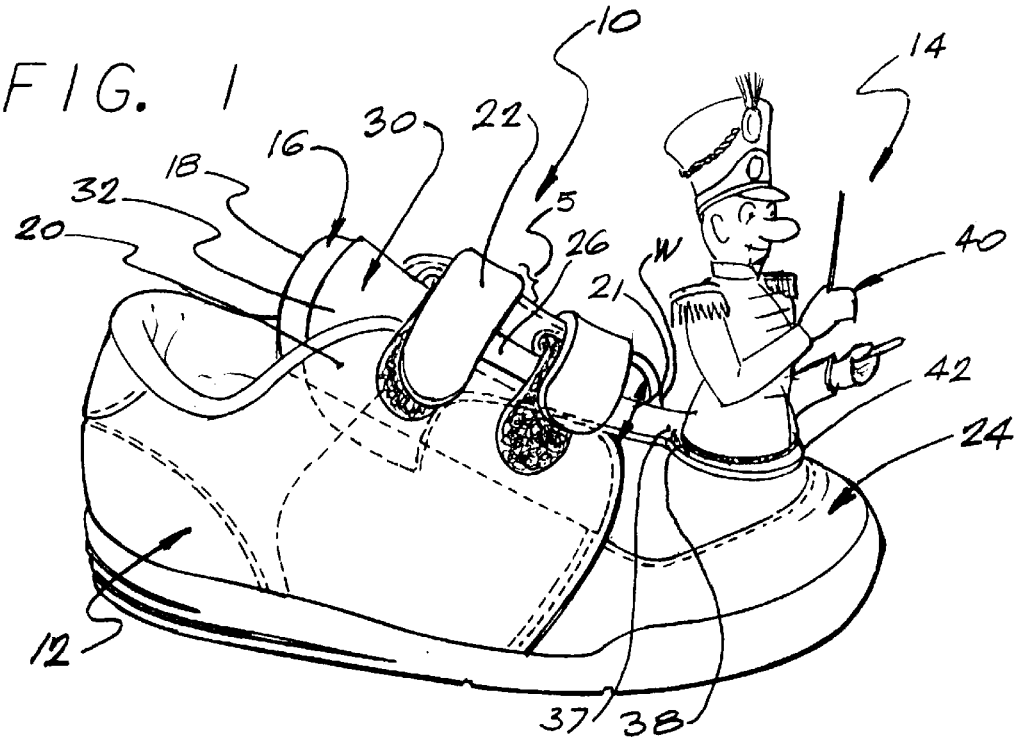
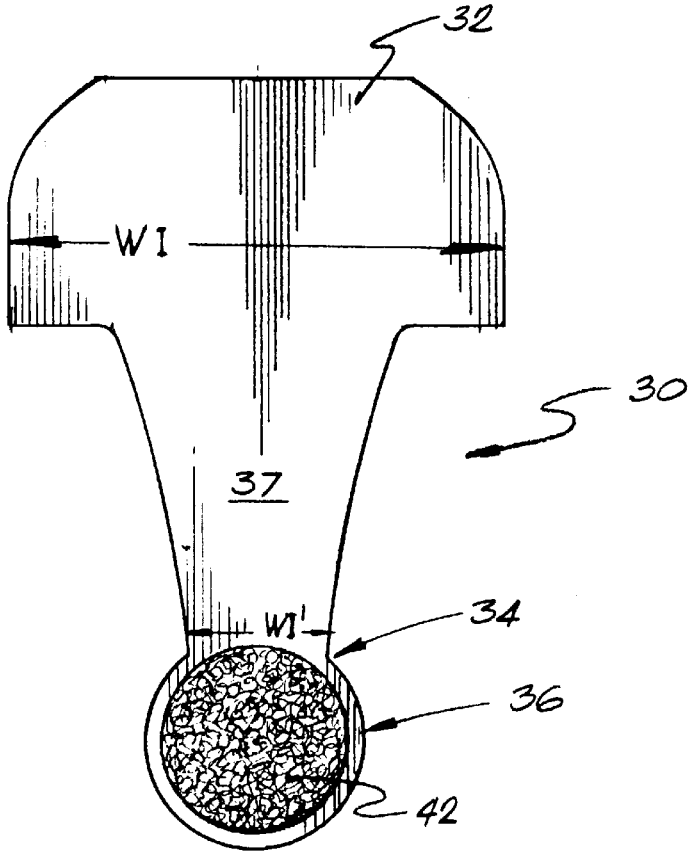
FIG. 2

FIG. 3
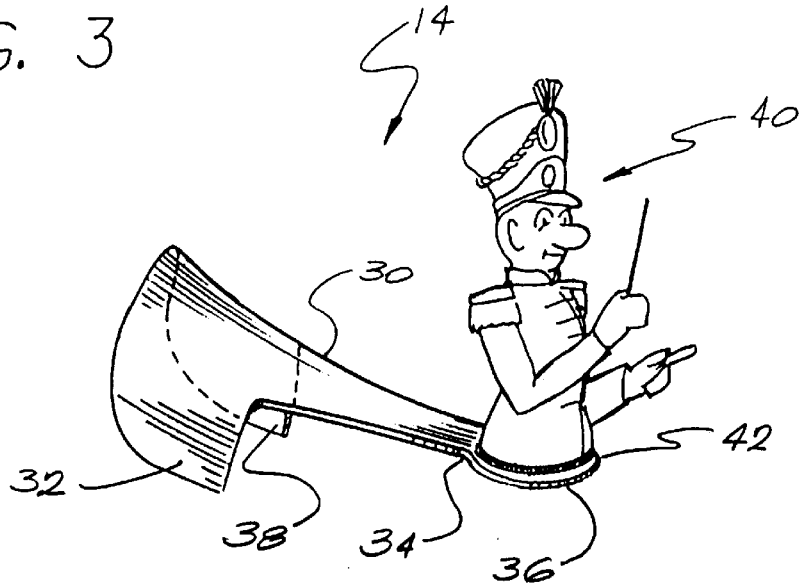
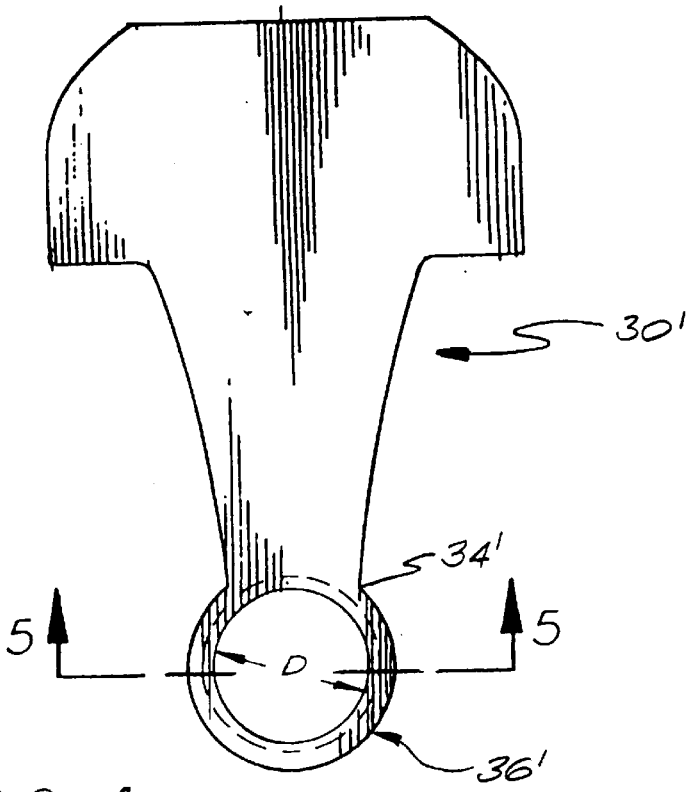
FIG. 4

FIG. 5
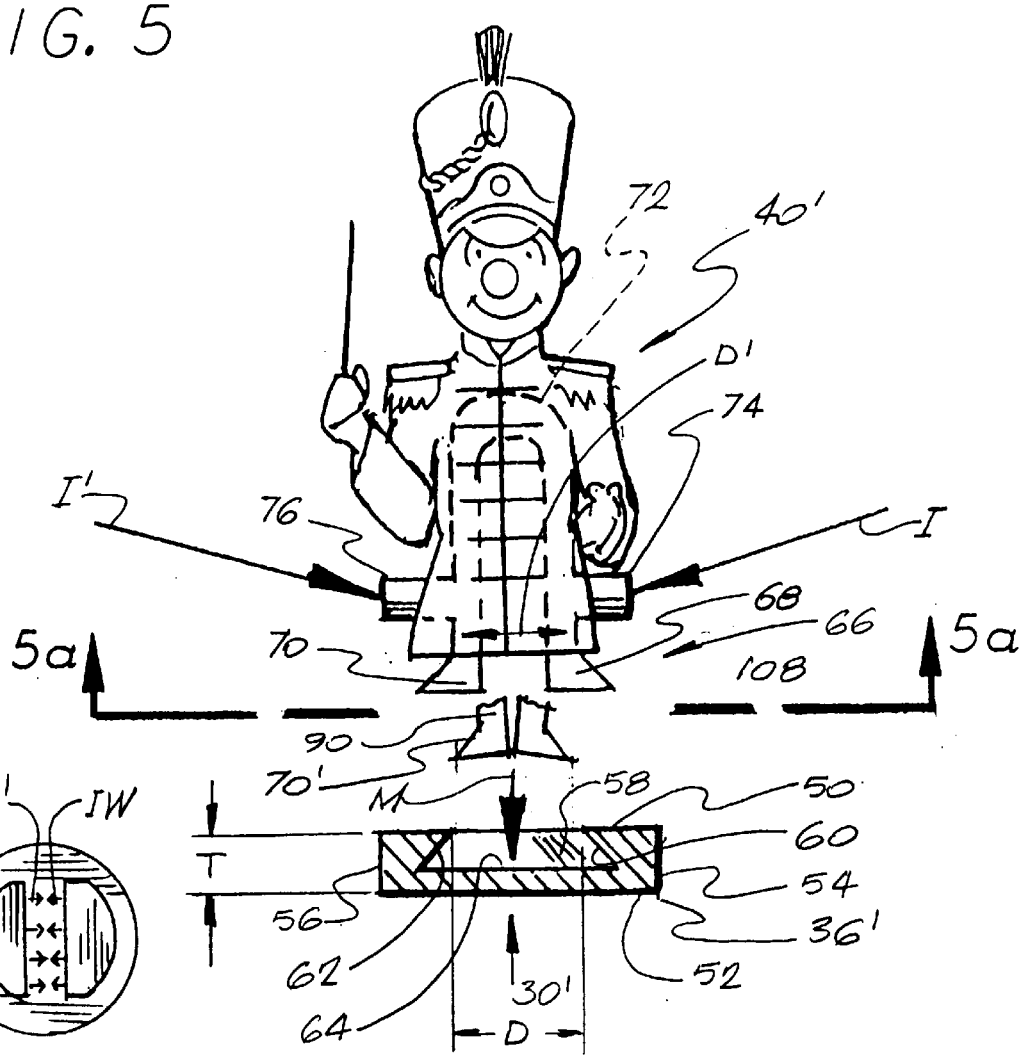
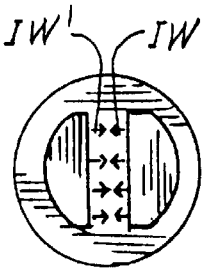
FIG. 5a
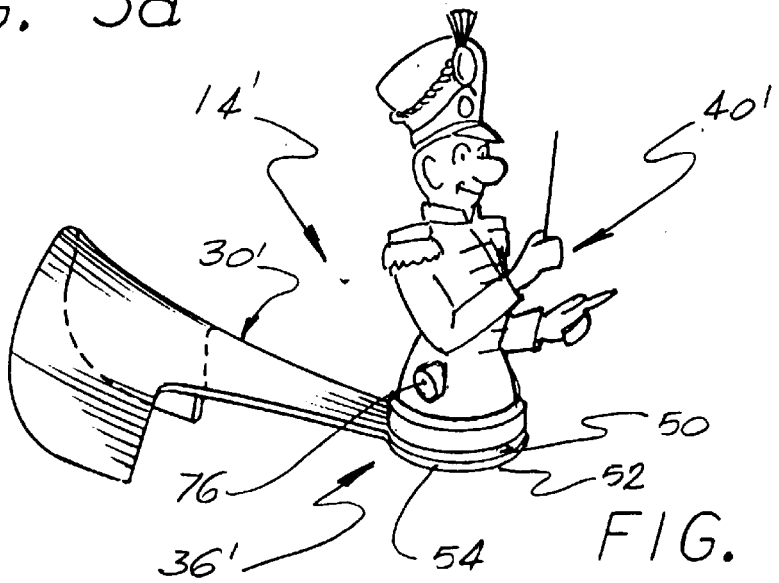
FIG. 6

DECORATIVE SHOE ACCESSORY

TECHNICAL FIELD OF THE INVENTION

The present invention relates to the general art of wearing apparel, and to the particular field of shoes and accessories therefor.

BACKGROUND OF THE INVENTION

While the main purpose of footwear is to protect and support the foot of a wearer, the ornamental appearance of footwear has always been important. In recent years, it has become increasingly popular, especially among children, to wear special decorations on shoes. These decorations can be ornamental or can enhance the appearance of clothing worn with the shoes.

For many reasons, including economic, any means used to ornament the appearance of a shoe should be easy and expeditious to apply, versatile, and attractive to as many potential wearers as possible.

Therefore, there is a need for a decorative means for use on shoes that is fascinating and appealing to a wide variety of potential users, yet is easy to apply.

In the past, the art has contained many accessories which can be affixed to a shoe to either ornament the appearance of the shoe or enhance the operation of the shoe. However, many of these items require some sort of interengagement between the item and the shoe or some portion of the shoe. For example, the elements disclosed in patents such as U.S. Pat. Nos. 2,650,399, 3,473,198, 4,999,888, 5,402,589, 5,459,947 and Des 308,283 are fixed to a shoe by interengaging with the laces of the shoe. Interengagement with the laces may make it difficult for a child to fix the item to the shoe, and may make it somewhat difficult to change the item if desired. Furthermore, if the item requires interengagement with the laces of the shoe, the item may not be amenable for use on shoes that are closed by other means, such as by means of hook-and-loop fasteners. This restriction limits the versatility of the item and may tend to wear out the laces in some instances. Other items that are known in the art, such as disclosed in U.S. Pat. Nos. 1,229,940, 2,022,554, 5,042,119, 5,671,517 and 5,566,477 are primarily intended to protect the laces of the shoe, and thus suffer from the same problems as just discussed.

Therefore, there is a need for a decorative means for use on shoes that is fascinating and appealing to a wide variety of potential users and does not require interengagement with a portion, such as the laces, of the shoe.

SUMMARY OF THE INVENTION

It is a main object of the present invention to provide a decoration for footwear that is amusing and fascinating to a wide variety of wearers, including children.

It is another object of the present invention to provide a decoration for footwear that will encourage children to wear shoes.

It is another object of the present invention to provide a decoration for footwear that is easy to change.

It is another object of the present invention to provide a decoration for footwear that can be used to teach the concept of "left" and "right."

It is another object of the present invention to provide a decoration for footwear that will not be limited to use with lace shoes, but will not tend to wear out laces when used with lace shoes.

These, and other, objects are achieved by a decorative novelty assembly for use with a shoe that has a body portion thereof located beneath the flaps of the shoe. The overlying nature of the flaps relative to the body portion creates friction on the body portion. The decorative novelty assembly is releasably held in place by the frictional engagement associated with the overlying position of the shoe securing assembly relative to the body portion of the novelty decorative assembly. The means for holding the novelty decorative assembly on the shoe consists entirely of the frictional engagement associated with this overlying configuration of the shoe flaps and the body portion of the novelty assembly and thus does not rely on any particular form of shoe closing system.

In this way, the assembly of the present invention is easily attached to and removed from the shoe while that assembly is securely held in place on the shoe thereby making it versatile and useable with either lace shoes or other forms of shoes, including hook-and-loop fastener shoes. The assembly is also quickly and easily attached and removed from the shoe, even by a young child with limited hand dexterity. Because the assembly is so easily attached and removed, a wide variety of novelty assemblies can be used thereby widening the appeal of the assembly to both male and female as well as adults.

In accordance with one aspect of the invention, the insert assembly may be used with shoes having flaps drawn together over the instep of the user and having a relatively narrow opening extending to the toe box of the shoe, and the insert assembly may have a narrow front portion which extends through the narrow opening, and a wider rear portion having a width greater than that of the opening.

Furthermore, a three-dimensional novelty object is releasably attached to the body portion of the assembly, preferably to the front portion of the insert assembly, overlying the toe of the shoe. This adds even further versatility and appeal to the assembly because the appearance of the assembly can be changed even after the assembly is in place on the wearer's foot.

Other objects, features and advantages of the invention will become apparent from a consideration of the following detailed description and the accompanying drawings.

BRIEF DESCRIPTION OF THE DRAWING FIGURES

FIG. 1 is a side and top perspective view of a shoe having one form of the decorative shoe insert assembly thereon.

FIG. 2 is a top, plan view of the body portion of the decorative shoe insert assembly shown in FIG. 1.

FIG. 3 is a side and top perspective view of the first form of the decorative shoe insert assembly of the present invention.

FIG. 4 is a top plan view of the body portion of another form of the decorative shoe insert assembly.

FIG. 5 is an exploded end elevational view of the FIG. 4 decorative shoe insert assembly with a removable three-dimensional object for releasable attachment thereto.

FIG. 5*a* is a view taken along line 5*a*–5*a* of FIG. 5 showing the means for releasably attaching the three-dimensional object to the body portion of the FIG. 5 insert assembly.

FIG. 6 is a side and top perspective view of the decorative shoe insert assembly of FIG. 5 in an assembled configuration.

Figure 7:
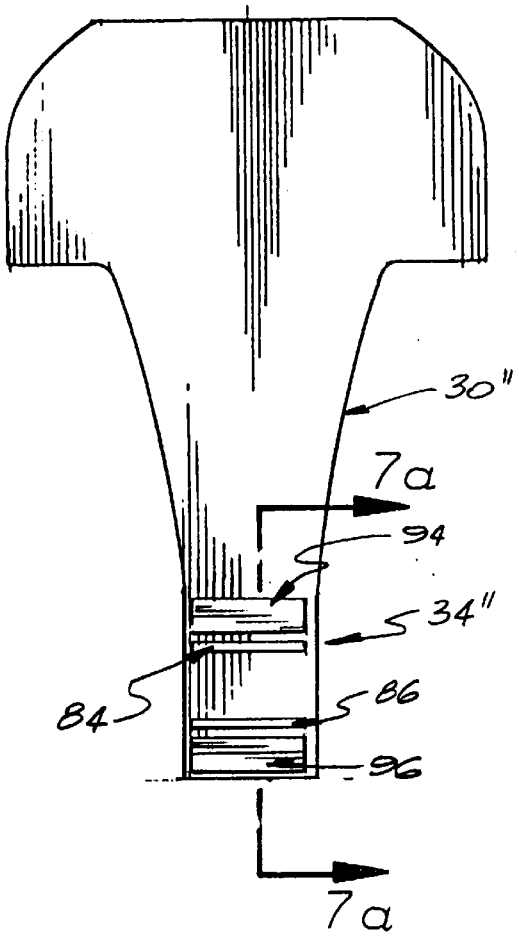

FIG. 7 is a top plan view of the body portion of another form of the present invention.

Figure 7A:
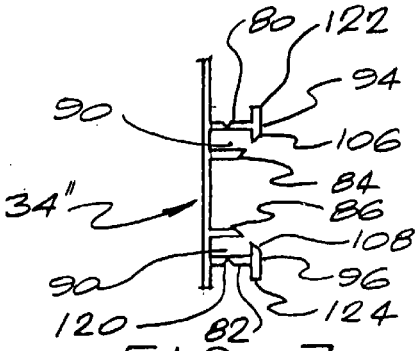

FIG. 7*a* is a view taken along line 7*a*–7*a* of FIG. 7 showing another form of attaching means for attaching the three-dimensional object to the insert body portion.

Figure 8:
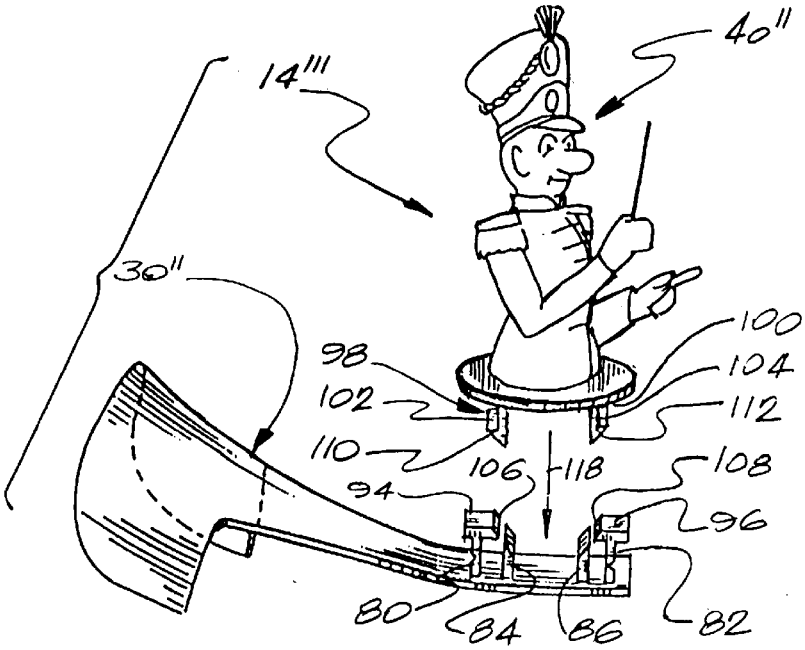

FIG. 8 is an exploded perspective view showing the FIG. 7 attaching means and a three-dimensional object associated therewith.

DETAILED DESCRIPTION OF THE PREFERRED EMBODIMENT OF THE INVENTION

Shown in FIG. 1 is a combination 10 of a shoe 12, such as a child's shoe, and a decorative shoe insert assembly 14. Insert assembly 14 is easily attached to and removed from shoe 12 even by a young child with limited hand dexterity. As will also be disclosed below, insert assembly 14 can also be easily changed and modified, even after it is in place on the wearer's shoe, thereby adding further versatility to the overall combination.

More specifically, shoe 12 accommodates a wearer's foot and has a tongue 16 having a top end 18 locatable adjacent to a top portion of an instep portion of the wearer's foot. Shoe 12 further includes flexible opposing flaps 20 and 21 extending over tongue 16.

Shoe 12 further includes securing means such as laces or hook-and-loop fasteners 22, for pulling flaps 20 and 21 together and holding shoe 12 onto the wearer's foot. The combination of the securing means and the flaps will be referred to as securing assembly S, with securing assembly S holding the shoe on the wearer's foot. Shoe 12 further includes a toe box 24 for accommodating the toes of the wearer and a narrow opening 26 between the flaps. Opening 26 has a predetermined width W extending from below the flaps 20 and 21 through to the upper surface of the toe box 24, and a length that extends along the upper surface of the tongue under securing assembly S and out to the top of toe box 24.

Decorative shoe insert assembly 14 is intended to be attractive and fascinating to children in the preferred embodiment of the invention, but can include many different forms that are attractive to adults as well and can be attractive to both males and females. Furthermore, the decorative shoe insert can be selected to encourage children to wear shoes, and one insert can be used for the left foot and another for the right foot thereby forming a tool to teach children the concept of "left" and "right." It is noted that several forms of decorative inserts are disclosed herein; however, these are only intended as examples of the best mode, and are not intended to be limiting. Those skilled in the art can envision other forms of decorative items based on the teaching of this disclosure, and these forms also are intended to be encompassed by this disclosure.

Specifically referring to FIGS. 1 and 2, it is seen that in the preferred form of the invention, decorative insert assembly 14 has a body portion 30 extending over tongue 16 and under securing assembly S whereby securing assembly S is in an overlying configuration relative to insert body portion 30. Body portion 30 has an exposed distal portion 36 located beyond securing assembly S and adjacent to toe box 24 of shoe 12. Insert body portion 30 is elongated and has a broad rear area 32 at one end to be located adjacent to top end 18 of tongue 16 and which has a width WI greater than predetermined width W, and tapers and has a front portion 34 having a width WI' which is narrower than rear portion 32 and narrower than the predetermined width. Body portion 30 extends from rear area 32 to beyond securing assembly S to exposed distal portion 36, which also has a width which is preferably less than the predetermined width.

Combination 10 further includes means for attaching insert assembly 14 to shoe 12. As shown in the FIG. 1 embodiment of the invention, insert body portion 30 is interposed between flaps 20 and 21 and the securing means and tongue 16. Positioning novelty item body portion 30 so that securing assembly S overlies body portion 30 has friction associated therewith. Friction is generated at top surface 37 of insert body portion 30 and the portion of securing assembly S that contacts top surface 37 and at bottom surface 38 of body portion 30 and either a portion of tongue 16 or a portion of the wearer's foot that is in contact with bottom surface 38.

The means for attaching the insert to the shoe consists entirely of the friction associated with the location of insert novelty item body portion 30 so that securing assembly S overlies body portion 30. It is this friction that holds insert body portion 30 in place. Since there is no other element used to hold insert body portion 30 in place, this body can be used in association with any form of shoe including the hook-and-loop form shown, laces, hooks, snaps or the like and is not likely to wear out the laces or the like of the shoe. This also makes insert assembly 14 easily placed and removed even by one having little hand dexterity, and encourages a wearer to change the insert to suit his or her mood, clothes, or the like. This versatility is a special feature of the insert assembly 14.

Insert assembly 14 includes a removable three-dimensional object 40 such as an ornament or a toy or the like. The object can be directed to boys or girls, adults or children or the like. Object 40 is releasably held on exposed distal portion 36 of the body portion by a mating securing means, such as hook-and-loop material 42 on insert body portion 30 and on the bottom of object 40 for removably securing object 40 to the distal portion 36 of insert body portion 30. The releasable nature of the means attaching object 40 to body portion 30 permits that object to be easily changed even after assembly 14 is in place on the wearer's shoe. This adds further versatility to the assembly since a wearer can change the appearance of his or her shoes even after the assembly is in place.

As can be seen in FIG. 3, rear board area 32 and body portion 30 are curved to fit over the wearer's foot. Body portion 30 may be formed of flexible, or semi-rigid, or stiff but flexible material, such as a plastic material or the like, to protect the wearer's foot if desired. The curved configuration of body portion 30 adds comfort to insert assembly 14 and increases the frictional engagement between insert 14 and shoe 12.

The hook-and-loop fastener is one form of mating securing means, another form is shown in FIGS. 4–6 which includes a male element on object 40' and a female element on body portion 30'. As shown in FIGS. 4–6, distal portion 36' of body portion 30' includes a top surface 50, a bottom surface 52 and a thickness T measured between top surface 50 and bottom surface 52. Distal portion 36' also has a first side 54 and a second side 56. A trapezoidal cutout 58 is defined in distal portion 36' and includes sides 60 and 62 as well as bottom 64. Sides 60 and 62 are separated by a distance D at top surface 50. Cutout 58 forms the female element of the mating securing means.

As shown in FIG. 5, three-dimensional object 40' includes a bottom section 66 which forms the male element of the mating securing means. Bottom section 66 has two triangular portions 68 and 70 connected together by a hairpin shaped element 72 located inside the body of object 40'. Each portion 68 and 70 has an angled surface 68' and 70' which is angled to mate with sides 60 and 62 respectively and which are spaced apart by a distance D' which is greater than distance D. The front end edges of elements 68 and 70 are also spaced apart a distance greater than distance D in the spaced-apart configuration thereof shown in FIG. 5. However, as will be understood from the following disclosure, these elements can be forced together so the spacing between the front end edges of elements 68 and 70 is smaller than spacing D.

Element 72 is flexible and can be bent to force element 68 towards element 70 so the elements 68 and 70 are spaced close together whereby they can be moved into cutout 58 as indicated by arrow M in FIG. 5. However, the material of element 72 is such that once it is released, it moves elements 68 and 70 back into a configuration that frictionally engages surfaces 68' and 70' with sides 60 and 62 respectively with the front end edges of elements 68 and 70 spaced apart by a distance greater than distance D. The angled configuration of the cutout and the elements 68 and 70 traps these elements in the cutout thereby attaching object 40' to body portion 30'.

Object 40' also includes projections 74 and 76 that are attached to element 72 and close that element in the manner discussed when inwardly-directed pressure is applied to the outer surfaces of these projections 74 and 76 in the directions indicated by arrows I and I' in FIG. 5. As can be seen by comparing FIGS. 5 and 5*a*, inwardly directed pressure moves elements 68 and 70 from the spaced-apart position shown in FIG. 5 to the abutting position shown in FIG. 5 in direction shown in FIG. 5*a* by arrows IW and IW'. The attached object is shown in FIG. 6. Again, the mating securing means just described permits easy attachment and detachment of object 40' whereby it is easily changed as desired by the wearer.

Yet another form of mating securing means is shown in FIGS. 7, 7*a* and 8. As shown in FIGS. 7, 7*a* and 8, the mating securing means of this form includes two first prongs 80 and 82 on the front portion 34" of body portion 30" and two second prongs 84 and 86 on front portion 34" of body portion 30". First and second prongs 80, 84 and 82, 86 are spaced apart from each other and second prongs 84 and 86 are located between first prongs 80 and 82 with a gap 90 defined between each first prong and the second prong adjacent thereto. Each first prong 80 and 82 has a gap-covering element 94 and 96 respectively extending toward the second prong located adjacent thereto and spans gap 90. Object 40" has first and second mating prongs 98 and 100 thereon, with each of the mating prongs 98 and 100 having a gap-engaging head 102 and 104 respectively thereon and being positioned to locate the gap-engaging heads in gaps 90 when object 40" is held on insert body portion 30". Each gap-covering element 94 and 96 has an angled surface, surfaces 106 and 108, and each of the gap-engaging heads has an angled surface, surfaces 110 and 112, that is angled to correspond to the angle of gap-covering elements whereby gap-covering elements 94 and 96 are forced out of a gap-spanning position as the gap-engaging elements are forced into gaps 90 as object 40" is moved from the position shown in FIG. 8 in the direction shown by arrow 118 onto body portion 30". Prongs 80 and 82 are formed of a flexible material, such as plastic or the like, and can include a weakening hinge, such as hinge 120 in prong 82, whereby prongs 80 and 82 move outwardly and away from corresponding prongs 84 and 86 to permit first and second mating prongs 98 and 100 to move past gap-covering elements 94 and 96 and then move back to position gap-covering elements 94 and 96 over gaps 90 after gap-engaging heads 98 and 100 have moved into gaps 90. With gap-engaging heads 98 and 100 in gaps 90 and gap-covering heads 94 and 96 positioned over gaps 90, gap-engaging heads 98 and 100 are trapped in gaps 90 to attach object 40" to insert body portion 30".

Each gap-covering element 94 and 96 has a finger-engaging portion 122 and 124 located outside of gaps 90 for moving gap-covering elements 94 and 96 respectively away from a gap-covering position such as shown in FIG. 7*a* to release object 40" from insert body portion 30".

It is understood that while certain forms of the present invention have been illustrated and described herein, it is not to be limited to the specific forms or arrangements of parts described and shown. Thus, by way of example and not of limitation, the body portion 30 could overlie the shoe flaps but lie under the hook and loop straps 20 or the laces of the shoe. Also, instead of the figure shown in the drawings, the removable object could be an action figure, an animal, an ornament, or any other three-dimensional object of decorative or advertising interest. Accordingly, the present invention is not limited to the precise embodiments as shown and described hereinabove.

What is claimed is:

1. In combination:

a.) a shoe for accommodating a wearer's foot and having
  1.) a tongue having a top end locatable adjacent to a top portion of an instep portion of the wearer's foot and an upper surface facing away from the wearer's foot;
  2.) flexible opposing flaps extending over said tongue;
  3.) securing means such as laces or hook-and-loop fastening straps for pulling said flaps together and forming a securing assembly for holding said shoe onto the wearer's foot;
  4.) a toe box for accommodating the toes of the wearer;
  5.) said shoe having a narrow opening having a predetermined width and extending from the upper surface of the tongue under said securing means and out to adjacent to the top of the toe box of said shoe;

b.) a decorative shoe insert assembly having
  1.) a body portion extending over said tongue and under said securing means whereby said securing means is in an overlying configuration relative to said body portion;
  2.) an exposed distal portion located beyond said securing means and adjacent to the toe box of said shoe;
  3.) said insert body portion being elongated and having a broad rear area at one end to be located adjacent to the top end of said tongue and which has a width greater than said predetermined width, and a narrower front portion extending from said rear area to beyond said securing means to said exposed distal portion and having a width less than said predetermined width;

c.) means attaching said insert assembly to said shoe and consisting entirely of the overlying configuration of said securing flaps, and said securing means relative to said insert body portion and frictional association between said insert body and said securing means;

d.) a removable three-dimensional object such as an ornament, a figure, or toy; and e.) mating securing means for removably securing said object to the distal portion of said insert body portion.

2. The combination defined in claim 1 wherein said mating securing means includes two first prongs on the front portion of said body portion and two second prongs on the front portion of said body portion, said first and second prongs being spaced apart from each other with said second prongs being located between said first prongs with a gap being defined between each first prong and the second prong adjacent thereto, each of said first prongs having a gap-covering element extending toward the second prong located adjacent thereto and spanning said gap; said object having first and second mating prongs thereon, each of said mating prongs having a gap-engaging head thereon and being positioned to located said gap-engaging heads in said gaps when said object is held on said insert body, each of said gap-covering elements having an angled surface, each of said gap-engaging heads having an angled surface that is angled to correspond to the angle of said gap-covering elements whereby said gap-covering elements are forced out of a gap-spanning position as said gap-engaging elements are forced into said gaps, said prongs being formed of a flexible material whereby said prongs move to permit said gap-engaging head to move past said gap-covering elements over said gaps after said gap-engaging heads have moved into said gaps whereby said gap-engaging heads are trapped in said gaps to releasably attach said object to said insert body.

3. The combination defined in claim 2 wherein each of said gap-covering elements has a finger-engaging portion located outside of said gaps for moving said gap-covering elements away from a gap-covering position to release said object from said insert body.

4. A combination as defined in claim 2 wherein said mating securing structure includes a female fastening element and a male fastening element.

5. The combination defined in claim 4 wherein said male element includes a flexible element biased into engagement with said female element.

6. In combination:

a.) a shoe for accommodating a wearer's foot and having:
  1.) flexible opposing flaps for extending over the wearer's foot;
  2.) securing means such as laces or hook-and-loop fasteners, for pulling said flaps together and forming a securing assembly for holding said shoe onto the wearer's foot; and
  3.) said shoe having a narrow opening between said flaps, said narrow opening having a predetermined width;

b.) a decorative shoe insert having:
  1.) a body portion extending under said flaps whereby said flaps are in an overlying configuration relative to said insert, the overlying configuration of said flaps relative to said body portion having friction associated therewith;
  2.) an exposed distal portion located beyond said securing means;
  3.) said insert being elongated and having a broad rear area at one end which has a width greater than said predetermined width, and a front portion extending from said rear area;

c.) means attaching said insert to said shoe and consisting entirely of the friction associated with the overlying configuration of said flaps relative to said insert;

d.) a removable three-dimensional object such as an ornament or toy; and e.) mating securing means for removably securing said object to said insert.

* * * * *